US009180688B2

(12) United States Patent
Nagahara

(10) Patent No.: US 9,180,688 B2
(45) Date of Patent: Nov. 10, 2015

(54) LABEL PRODUCTION APPARATUS AND LABEL PRODUCTION METHOD

(71) Applicant: SEIKO EPSON CORPORATION, Tokyo (JP)

(72) Inventor: Atsushi Nagahara, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/225,700

(22) Filed: Mar. 26, 2014

(65) Prior Publication Data

US 2014/0292983 A1 Oct. 2, 2014

(30) Foreign Application Priority Data

Mar. 28, 2013 (JP) ..... 2013-068290

(51) Int. Cl.
*B41J 2/01* (2006.01)
*B41J 3/407* (2006.01)
*B41J 11/66* (2006.01)

(52) U.S. Cl.
CPC ..... *B41J 3/4075* (2013.01); *B41J 11/663* (2013.01)

(58) Field of Classification Search
CPC ..... B41J 11/00; B41J 11/66; B41J 11/663; B41J 11/666
USPC ..... 347/104; 156/384, 387
See application file for complete search history.

(56) References Cited

U.S. PATENT DOCUMENTS

| | | | | |
|---|---|---|---|---|
| 5,531,530 | A * | 7/1996 | Kuramoto et al. | 400/593 |
| 2004/0038034 | A1* | 2/2004 | Dominguez | 428/411.1 |
| 2007/0229641 | A1* | 10/2007 | Nakazawa | 347/104 |
| 2008/0029221 | A1* | 2/2008 | Dangami et al. | 156/379 |

FOREIGN PATENT DOCUMENTS

| | | |
|---|---|---|
| JP | 2007-293658 | 11/2007 |
| JP | 2007-295222 | 11/2007 |
| JP | 2010-149333 | 7/2010 |

* cited by examiner

*Primary Examiner* — Julian Huffman
*Assistant Examiner* — Sharon A Polk
(74) *Attorney, Agent, or Firm* — Workman Nydegger

(57) ABSTRACT

A label production apparatus includes a printing unit that prints a image onto a medium that includes a first base material, a second base material, and an adhesive layer between the first base material and the second base material; an inspection unit that inspects the image printed onto the medium; and a post-processing unit that cuts the first base material based on an inspection result from the inspection unit, the post-processing unit cutting the first base material using a first cut line that separates an area where the image is formed from the first base material in the case where a print defect has not been detected in the image, and cutting the first base material using a second cut line in which part of the first cut line is not cut in the case where a print defect has been detected in the image.

5 Claims, 12 Drawing Sheets

LABEL PRODUCTION APPARATUS AND LABEL PRODUCTION METHOD

BACKGROUND

1. Technical Field

The present invention relates to label production apparatuses and label production methods.

2. Related Art

Label production apparatuses that, for example, form images such as pictures, graphics, symbols (text), barcodes, and the like (label images) on a printing medium in which a mount, an adhesive layer, and a base material are layered in that order are known. Such a label production apparatus includes a printing unit that prints an image onto the base material and a post-processing unit that cuts the base material and the adhesive layer at the area where the image has been printed. After the cutting, unnecessary areas outside the image area are peeled away from the mount (this will also be called "scrap removal" hereinafter).

A label production apparatus in which an inspection unit that inspects printed label images is provided and only non-defective label images are cut while defectively-printed label images are removed as scraps along with the unnecessary areas has also been proposed (see JP-A-2010-149333, for example).

An operator positions and applies non-defective label images to areas from which the defectively-printed label images have been peeled away during the scrap removal.

However, according to the label production apparatus, when a printing defect has been detected, the defectively-printed label image is peeled away along with the unnecessary areas without being cut, and there has thus been a problem in that the operator cannot understand proper positions when applying the non-defective label images.

SUMMARY

It is an advantage of some aspects of the invention to provide a label production apparatus and a label production method in which it is easy to understand a position where a label image is to be applied.

A label production apparatus according to a first aspect of the invention includes: a printing unit that prints a label image onto a first base material of a printing medium that includes the first base material, a second base material, and an adhesive layer between the first base material and the second base material; an inspection unit that inspects the label image printed onto the printing medium; and a post-processing unit that cuts the first base material based on an inspection result from the inspection unit, the post-processing unit cutting the first base material using a first cut line that separates an area where the label image is formed from the first base material in the case where a print defect has not been detected in the label image by the inspection unit, and cutting the first base material using a second cut line in which part of the first cut line is not cut in the case where a print defect has been detected in the label image by the inspection unit.

Other features of the invention will be made clear by the descriptions in this specification and the appended drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

1. Overview

Figure 1:
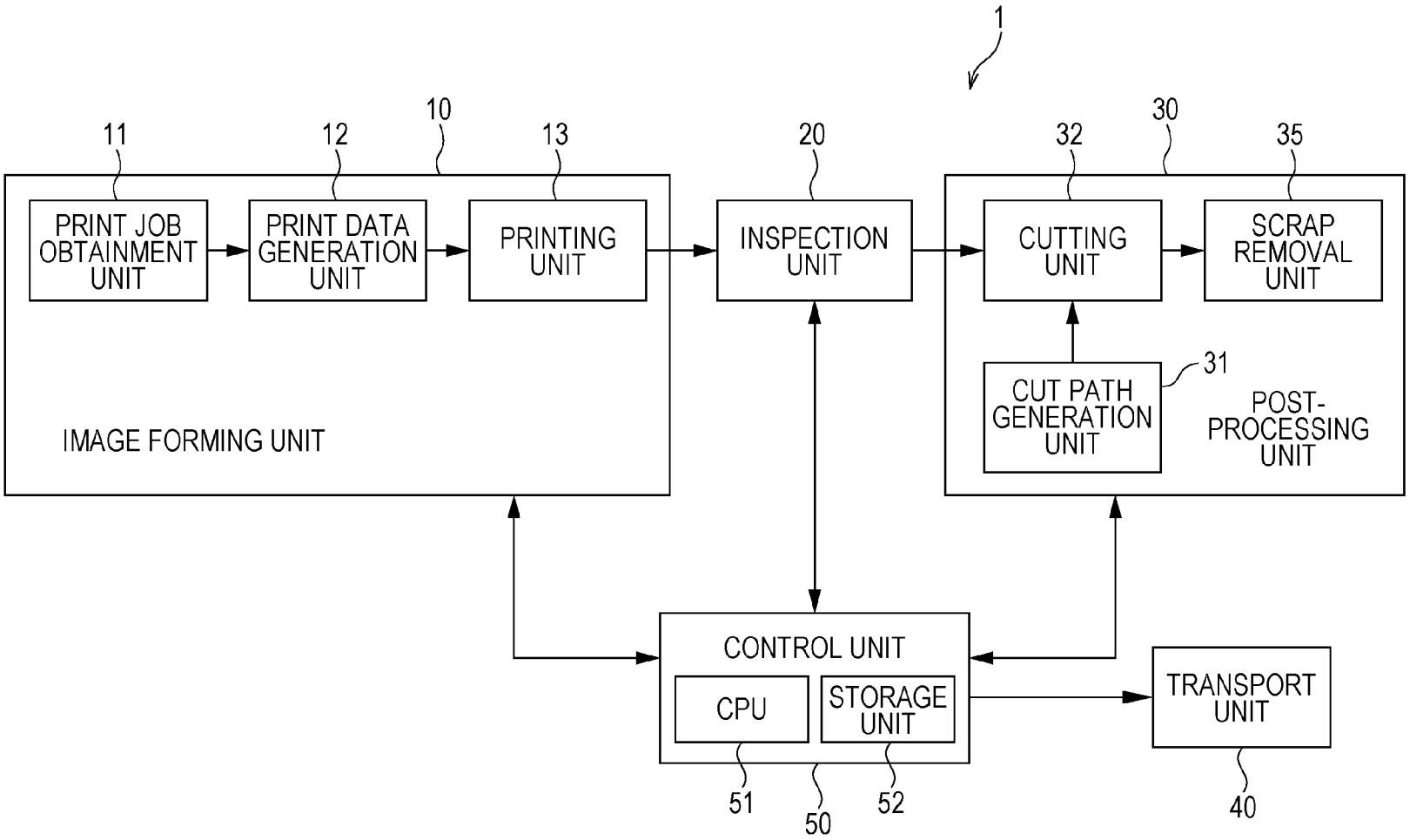
FIG. 1 is a block diagram illustrating the configuration of a label production apparatus.

The descriptions in this specification and the appended drawings will make clear at least the following points.

A label production apparatus includes a printing unit that prints a label image onto a first base material of a printing medium that includes the first base material, a second base material, and an adhesive layer between the first base material and the second base material; an inspection unit that inspects the label image printed onto the printing medium; and a post-processing unit that cuts the first base material based on an inspection result from the inspection unit, the post-processing unit cutting the first base material using a first cut line that separates an area where the label image is formed from the first base material in the case where a print defect has not been detected in the label image by the inspection unit, and cutting the first base material using a second cut line in which part of the first cut line is not cut in the case where a print defect has been detected in the label image by the inspection unit.

According to this label production apparatus, after a print-defective label image is peeled away along with an unnecessary portion, a cut impression remains in a position where the label image has been formed. Accordingly, the position where a non-defective label image is to be applied can be made easy to understand.

It is desirable for the stated label production apparatus to further include a storage unit that stores a table associating a type of the printing medium with a range in which the first base material is not cut, and for the second cut line to be generated by the label production apparatus based on the printing medium being used by referring to the table.

According to this label production apparatus, cutting can be carried out in a manner suited to the printing medium.

It is desirable for the stated label production apparatus to further include a peeling unit that, after the first base material has been cut by the post-processing unit, peels an area of the first base material, aside from the label image, that has been cut along the first cut line away from the second base material starting from a predetermined side, and for the second cut line to not cut an area on the predetermined side of the first cut line.

According to this label production apparatus, a print-defective label image can be prevented from not being peeled away and remaining on the mount.

It is desirable, in the stated label production apparatus, for the printing medium to be transported in a transport direction in the peeling unit, and for the predetermined side to be a downstream side in the transport direction.

According to this label production apparatus, the unnecessary portion can be peeled away while transporting the printing medium in the transport direction.

In the stated label production apparatus, it is preferable for the second cut line to be generated so that an area of the first base material surrounding the label image remains on the second base material after the peeling performed by the peeling unit.

According to this label production apparatus, the location where a label image is to be applied can be made easy to understand.

Furthermore, a label production method includes printing a label image onto a first base material of a printing medium that includes the first base material, a second base material, and an adhesive layer between the first base material and the second base material; inspecting the label image printed onto the printing medium; and post-processing to cut the first base material based on an inspection result from the inspecting, in which the first base material is cut using a first cut line that separates an area where the label image is formed from the first base material in the case where a print defect has not been detected in the label image in the inspecting, and the first base material is also cut using a second cut line in which part of the first cut line is not cut in the case where a print defect has been detected in the label image in the inspecting.

2. First Embodiment

The following embodiment describes a label production apparatus that prints images using the ink jet technique (called "label production apparatus 1" hereinafter) as an example.

Figure 2:
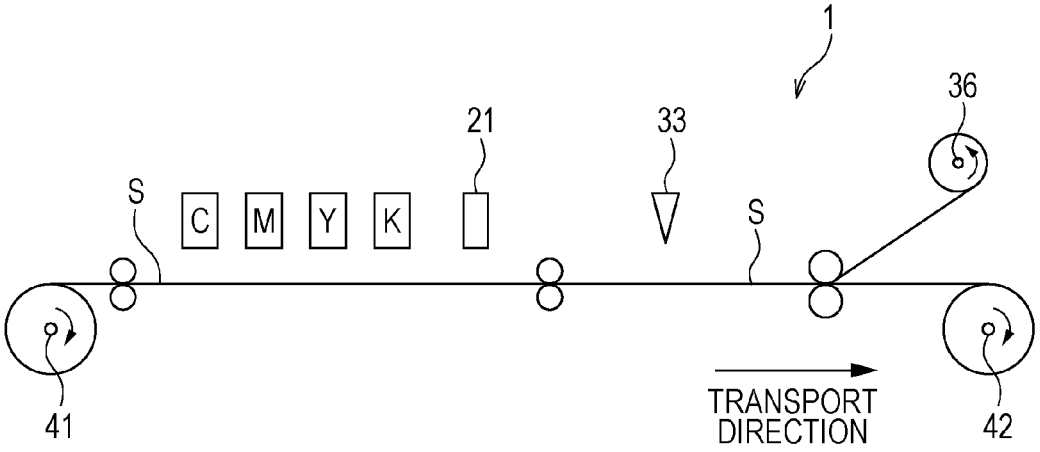
FIG. 2 is a schematic diagram illustrating the configuration of the label production apparatus.

FIG. 1 is a block diagram illustrating the configuration of the label production apparatus 1. As shown in FIG. 1, the label production apparatus 1 includes an image forming unit 10, an inspection unit 20 (corresponding to an "inspection unit"), a post-processing unit 30 (corresponding to a "post-processing unit"), a transport unit 40, and a control unit 50. FIG. 2 is a schematic diagram illustrating the configuration of the label production apparatus 1.

Figure 3:
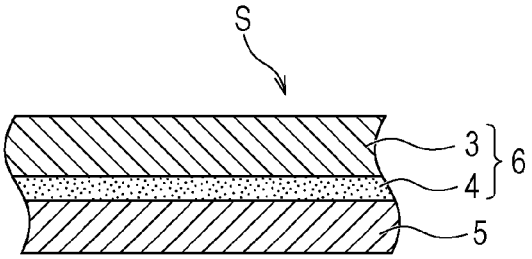
FIG. 3 is a cross-sectional view illustrating the configuration of roll paper.

Note that in this embodiment, paper that has been wound into a roll shape (called "roll paper S" (continuous paper) hereinafter) is used as an example of a medium upon which images are printed (this corresponds to a "printing medium"). FIG. 3 is a cross-sectional view illustrating the configuration of the roll paper S in this embodiment. As shown in FIG. 3, the roll paper S is configured of three layers, namely a base material 3 (corresponding to a "first base material"), a mount 5 (corresponding to a "second base material"), and an adhesive layer 4 provided between the base material 3 and the mount 5. One surface of the base material 3 (the surface on the opposite side of the base material 3 to the side on which the adhesive layer 4 is located) serves as a printing surface, and an image (a label image) is printed on that surface. The base material 3 and the adhesive layer 4 configure a seal member 6.

2.1 Image Forming Unit 10

The image forming unit 10 prints images (label images) onto the roll paper S.

As shown in FIG. 1, the image forming unit 10 includes a print job obtainment unit 11, a print data generation unit 12, and a printing unit 13.

The print job obtainment unit 11 obtains a print job from an input device (not shown). Note that data of images to be printed, data for cutting, and so on is inputted as the print job.

The print data generation unit 12 generates print data based on the print job obtained by the print job obtainment unit 11.

The printing unit 13 forms (prints) the label image on the roll paper S using the print data. Note that in this embodiment, the printing unit 13 is a line printer, and includes a plurality of heads disposed facing the roll paper S. Specifically, as shown in FIG. 2, four heads are provided, namely a cyan ink head C that ejects cyan ink, a magenta ink head M that ejects magenta ink, a yellow ink head Y that ejects yellow ink, and a black ink head K that ejects black ink. The cyan ink head C, the magenta ink head M, the yellow ink head Y, and the black ink head K are disposed at equal intervals in that order, starting from an upstream side in a transport direction.

A nozzle row in which a plurality of nozzles that eject ink are arranged in a paper width direction is provided in each head. Accordingly, dots can be formed along the entire width of the roll paper S at one time by ejecting ink from the heads toward the roll paper S as the roll paper S is transported in the transport direction. In this manner, the printing unit 13 prints the label images by ejecting ink from each of the heads toward the roll paper S that is transported in the transport direction.

2.2 Inspection Unit 20

The inspection unit 20 is a unit for inspecting the label images formed on the roll paper S. The inspection unit 20 according to this embodiment includes a scanner 21. As shown in FIG. 2, the scanner 21 is provided downstream, in the transport direction, from the heads of the image forming unit 10.

The scanner 21 obtains color information by scanning the roll paper S after printing. As a result, the scanner 21 generates a scanned image obtained by scanning the label images printed onto the roll paper S.

The inspection unit 20 inspects whether or not a given label image has been correctly printed (that is, whether the label image is defective or non-defective) by comparing the scanned image generated by the scanner 21 with the original image (the original image data).

2.3 Post-Processing Unit 30

The post-processing unit 30 includes a cut path generation unit 31, a cutting unit 32, and a scrap removal unit 35.

The cut path generation unit 31 generates cut lines (also called "cut path" hereinafter) used when cutting the seal member 6 of the roll paper S using the cutting unit 32. Note that the cut path need not be generated by the cut path generation unit 31 in the case where data for cutting obtained in the print job is used as-is.

The cutting unit 32 is a unit for cutting the seal member 6 of the roll paper S along the cut path. The cutting unit 32 according to this embodiment includes a laser cutter 33 that cuts the seal member 6 by emitting a laser beam and an alignment mark sensor (not shown) that detects an alignment mark printed onto the roll paper S. Note that the alignment mark is a mark used for timing control when cutting is performed using the laser cutter 33.

The scrap removal unit 35 (corresponding to a "peeling unit") is a unit for peeling away unnecessary portions (portions aside from the label images) of the seal member 6 in the roll paper S from the mount 5, and includes a scrap take-up shaft 36. The scrap take-up shaft 36 is disposed downstream from the laser cutter 33 in the transport direction and above a transport path, as shown in FIG. 2; the scrap take-up shaft 36 rotates as the roll paper S is transported, and peels away the unnecessary portions from the roll paper S.

Figure 4:
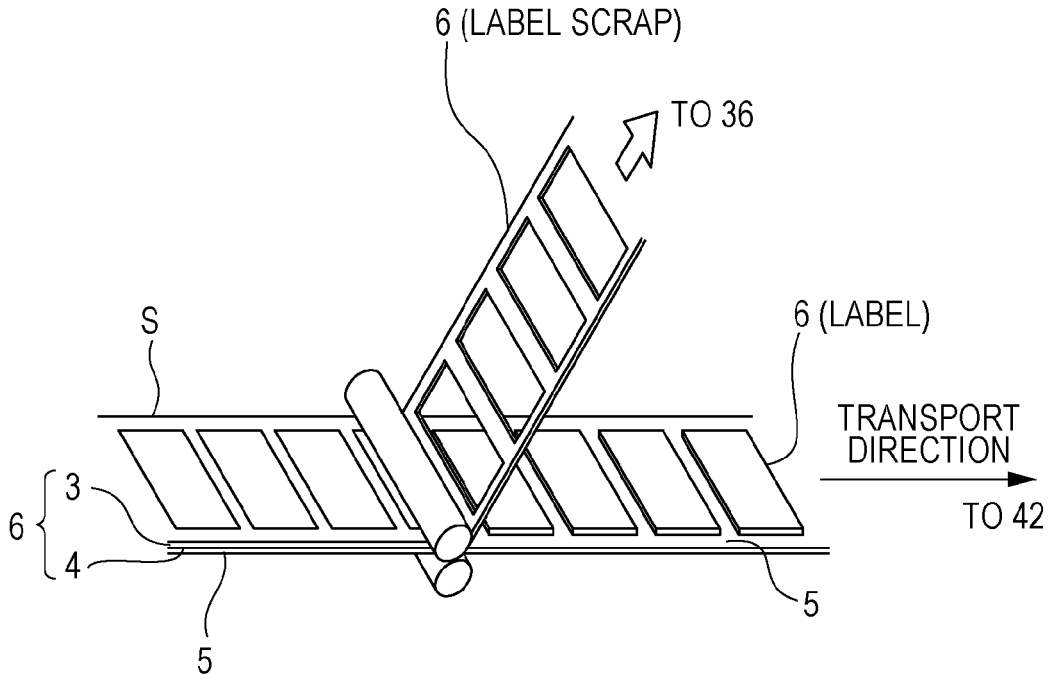
FIG. 4 is a diagram illustrating scrap removal.

FIG. 4 is a diagram illustrating an example of scrap removal. In this example, substantially rectangular label images have been printed onto the roll paper S, and the label images have been cut around using the laser cutter 33. As shown in FIG. 4, only the seal member 6 corresponding to the label images remains upon the mount 5 as a result of the unnecessary portions (the portions aside from the label images) of the seal member 6 in the roll paper S being taken up onto the scrap take-up shaft 36 (peeled away from the mount 5) after the cutting.

2.4 Transport Unit 40

The transport unit 40 is a unit that transports the roll paper S in a predetermined direction (called "transport direction" hereinafter), and includes a feeding shaft 41 and a take-up drive shaft 42.

The feeding shaft 41 is a shaft for feeding out the roll paper S in the transport direction, and in the transport path shown in FIG. 2, is disposed furthest upstream in the transport direction.

The take-up drive shaft 42 is, in the transport path shown in FIG. 2, disposed furthest downstream in the transport direction; the take-up drive shaft 42 transports the roll paper S in the transport direction and takes up the roll paper S on which the label images have been formed by rotating under the driving of a motor (not shown).

A plurality of rollers functioning as part of the transport unit 40 are disposed in the transport path between the feeding shaft 41 and the take-up drive shaft 42.

2.5 Control Unit 50

The control unit 50 is a unit for controlling operations performed by the respective units in the label production apparatus 1, and is communicably connected to the respective units via interfaces. The control unit 50 includes a CPU 51 and a storage unit 52. The CPU 51 executes programs (including the processes of various types of drivers) for driving the respective units of the label production apparatus 1. The storage unit 52 stores the programs executed by the CPU 51 and various types of data.

The control unit 50 controls the respective units in the label production apparatus 1 by the CPU 51 executing the programs stored in the storage unit 52. First, the control unit 50 controls the transport unit 40, causing a motor (not shown) to drive the take-up drive shaft 42 and transport the roll paper S in the transport direction. During this time, the control unit 50 controls the image forming unit 10, the inspection unit 20, and the post-processing unit 30 so as to execute the label production.

2.6 Operation of Label Production Apparatus 2.6.1 Comparative Example

Figure 5:
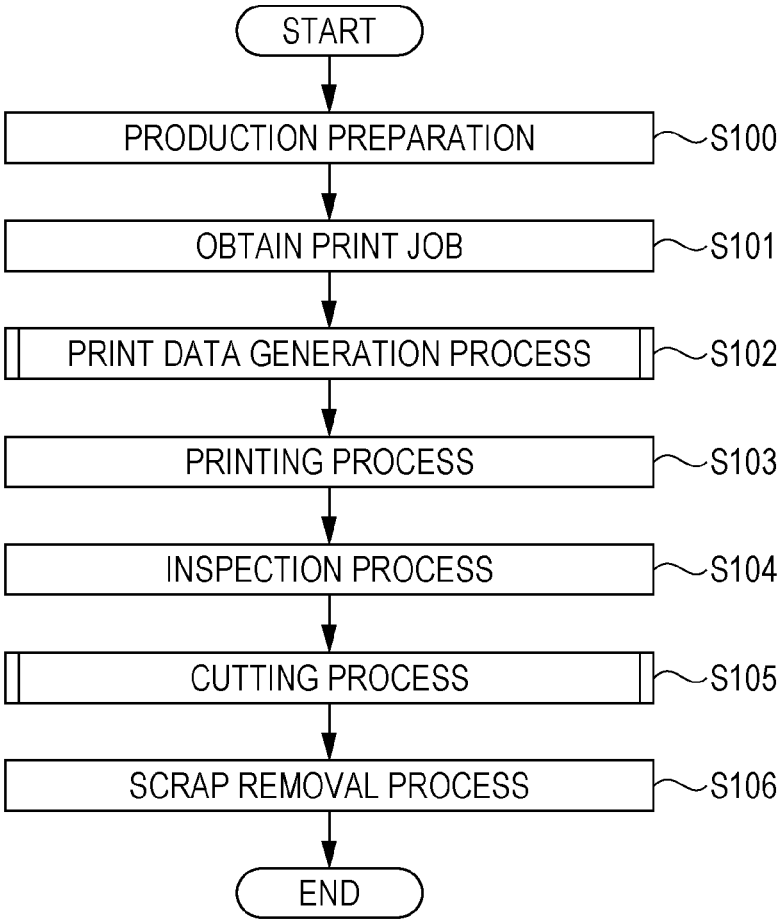
FIG. 5 is a flowchart illustrating label production operations performed by the label production apparatus.

FIG. 5 is a flowchart illustrating label production operations performed by the label production apparatus 1.

First, an operator operating the label production apparatus 1 carries out production preparation (S100). The "production preparation" refers to, for example, adjusting the position of a sensor in the cutting unit 32 (an alignment mark detection sensor), adjusting operation conditions of the scrap removal performed by the scrap removal unit 35, and so on.

Next, the operator loads a print job into the label production apparatus 1 from an input device (not shown). The print job obtainment unit 11 of the image forming unit 10 obtains the print job (S101). The print job obtained here includes image data expressing the actual image to be printed and cut line data corresponding to the image data (also called "cut path data" hereinafter). Note that the cut path data may be generated by the cut path generation unit 31 based on print data.

Figure 6:
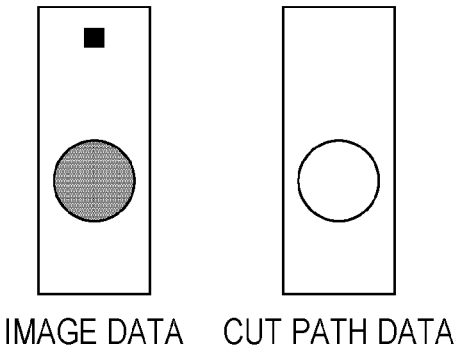
FIG. 6 is a diagram illustrating data obtained according to a comparative example.

FIG. 6 is a diagram illustrating data obtained in a comparative example. As shown in FIG. 6, in the comparative example, image data for printing an alignment mark (a mark indicated by a square in black) and a circular image (the label image) is obtained along with cut path data for cutting around the circular image. Note that each instance of data is bitmap data.

After the print job has been obtained, the print data generation unit 12 carries out a process for generating, from the image data, print data for the CMYK heads to eject colored ink (a print data generation process) (S102). The print data generation process will be described below.

Figure 7:
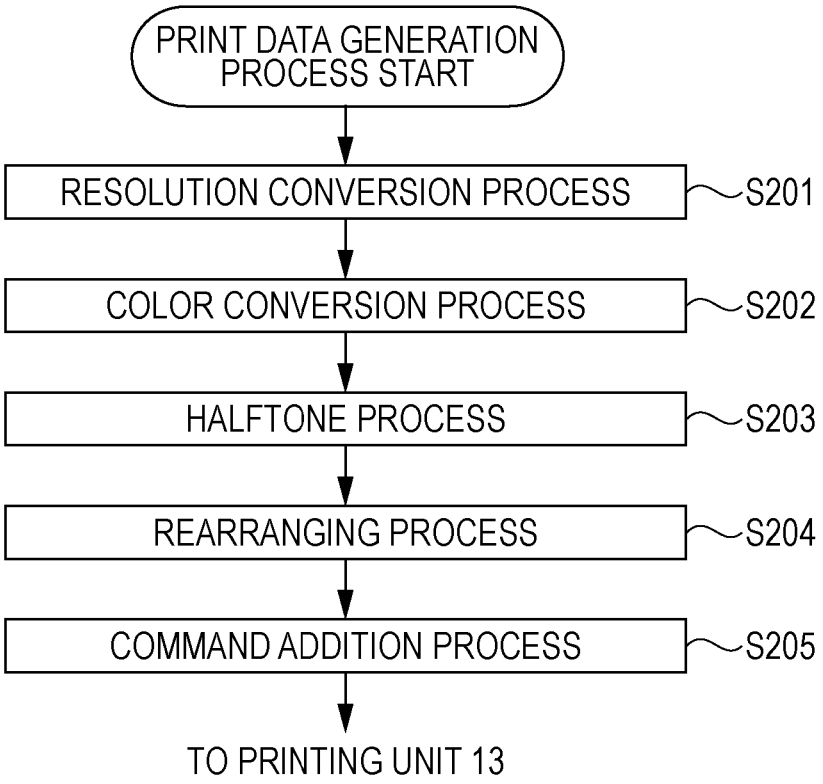
FIG. 7 is a descriptive diagram illustrating a print data generation process.

FIG. 7 is a descriptive diagram illustrating the print data generation process.

The print data generation unit 12 accepts the image data from the print job obtainment unit 11, converts the image data into print data in a format that can be interpreted by the printing unit 13, and outputs the print data to the printing unit 13. When converting the image data into the print data, the print data generation unit 12 carries out a resolution conversion process, a color conversion process, a halftone process, a rearranging process, a command addition process, and so on.

The resolution conversion process (S201) is a process for converting the image data (text data, graphic data, or the like) to image data having resolution with which printing is performed onto paper (a printing resolution). For example, in the case where a printing resolution of 720 by 720 dpi has been specified, the image data is converted into bitmap-format image data with a resolution of 720 by 720 dpi. Note that each piece of pixel data within the resolution-converted image data is multi-tone RGB data expressed by the RGB color space (for example, 256 tones). These tone values are specified based on the RGB image data.

The color conversion process (S202) is a process that converts RGB data into data in the CMYK color space. Image data in the CMYK color space is data that corresponds to the colors of the ink in the printing unit 13. To rephrase, the print data generation unit 12 creates image data in the CMYK plane based on the RGB data.

This color conversion process is carried out based on a table in which RGB data tone values and CMYK data tone values are associated with each other. This table is called a color conversion lookup table (LUT). Note that the color-converted pixel data is CMYK data having 256 tones expressed using the CMYK color space.

The halftone process (S203) is a process for converting data of a high number of tones into data having a number of tones that can be formed by the printing unit 13. Data expressing 256 tones is converted into 1-bit data expressing two tones, 2-bit data expressing four tones, and so on through this halftone process. The halftone-processed image data corresponds to 1-bit or 2-bit pixel data for each pixel, and this pixel data is data expressing a dot formation state for its corresponding pixel (that is, the presence/absence of a dot and the size of the dot). For example, in the case of two bits (four tones), the conversion results in four tones, namely no dot, corresponding to a dot tone value of "00"; small dot, corresponding to a dot tone value of "01"; medium dot, corresponding to a dot tone value of "10"; and large dot, corresponding to a dot tone value of "11". After setting a dot creation rate for the sizes of the respective dots, pixel data is created using dithering, γ correction, an error diffusion method, and so on so that the printing unit 13 forms the dots in a dispersed manner.

The rearranging process (S204) rearranges pixel data arranged in matrix form in a data order in which the pixel data is to be transferred to the printing unit 13, for each piece of pixel data. For example, this process rearranges the pixel data based on the order in which nozzles are arranged in each head.

The command addition process (S205) is a process that adds command data corresponding to the printing system to the data that has experienced the rearranging process. Transport data indicating a transport speed for the medium can be given as an example of command data.

Print data for each of the CMYK colors is generated from the image data shown in FIG. 6 as a result of these processes. The generated print data is then sent to the printing unit 13.

The control unit 50 causes each of the heads of the printing unit 13 to eject ink onto the roll paper S using the print data (print data for each of the CMYK colors) generated by the print data generation unit 12 while controlling the transport unit 40 to transport the roll paper S in the transport direction. A printing process for printing the image shown in FIG. 6 onto the roll paper S is carried out in this manner (S103 in FIG. 5). The image shown in FIG. 6 is repeatedly printed onto the roll paper S by continuing this printing process.

Next, the control unit 50 controls the inspection unit 20 to carry out an inspection process for inspecting the images printed by the printing unit 13 (S104). First, the scanner 21 is caused to scan an image printed onto the roll paper S when that image passes below the scanner 21. Then, the inspection unit 20 determines whether or not there is a defect by comparing data of the scanned image (scan data) with the image data (FIG. 6). To be more specific, the inspection unit 20 compares the scan data with the image data at the pixel level. A determination of "OK" is made when a difference between the colors of corresponding pixels is less than a threshold, whereas a determination of "NG" is made when the difference is greater than or equal to the threshold. Whether or not the printed image is non-defective is determined in this manner.

Figure 8:
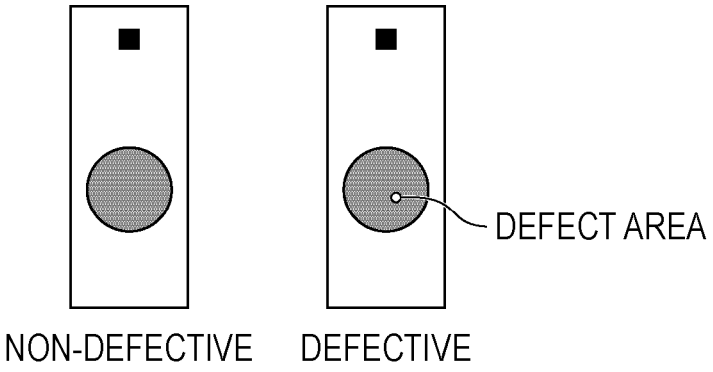
FIG. 8 is a diagram illustrating an inspection result.

FIG. 8 is a diagram illustrating an example of an inspection result. The picture on the left side of FIG. 8 indicates a non-defective scan result. In this picture, a pixel-level comparison with the image data (FIG. 6) has indicated that there are no areas where the color difference exceeds the threshold, and thus the image is determined to be non-defective. On the other hand, the picture on the right side of FIG. 8 indicates an example of a defective scan result. In this picture, an area where a dot has not been formed due to a nozzle missing or the like (a defective area) is present. Accordingly, a pixel-level comparison with the image data (FIG. 6) has indicated that there is an area where the color difference exceeds the threshold, and thus the image is determined to be defective.

An area of the roll paper S on which the inspection unit 20 has carried out the inspection process is transported to the post-processing unit 30. The control unit 50 causes the cutting unit 32 to carry out a cutting process in accordance with a result of the inspection performed by the inspection unit 20 (S105 in FIG. 5).

Figure 9:
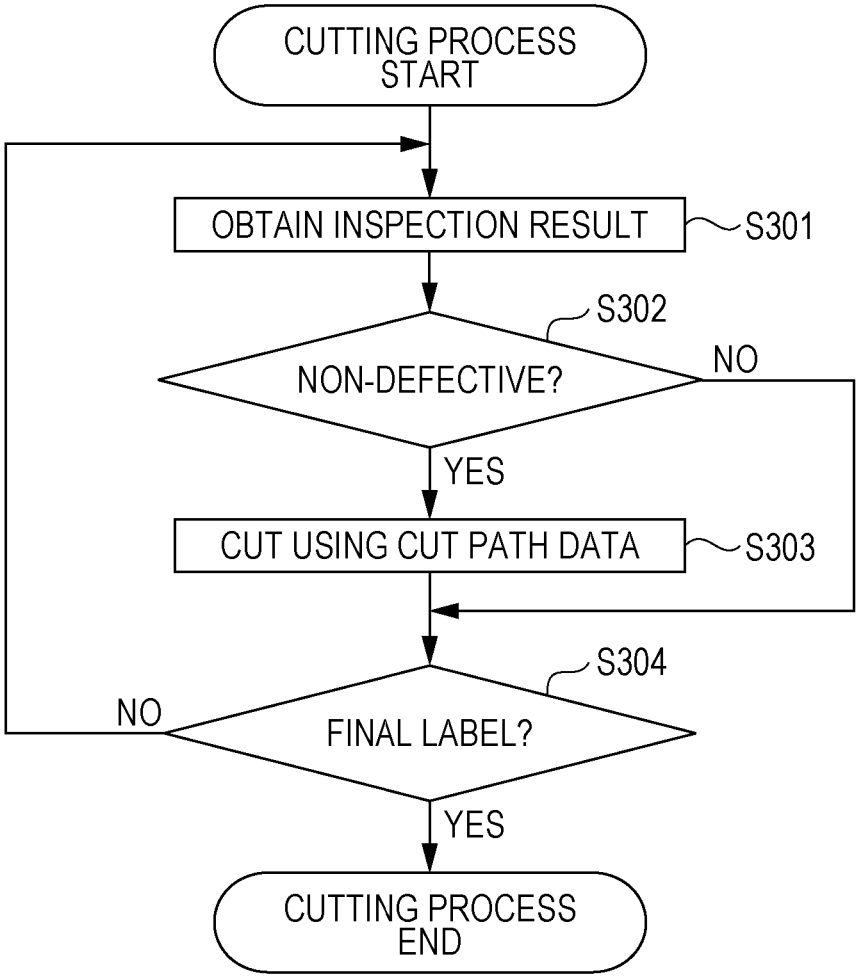
FIG. 9 is a flowchart illustrating operations performed in a cutting process according to the comparative example.

FIG. 9 is a flowchart illustrating operations performed in the cutting process according to the comparative example.

First, the control unit 50 obtains the inspection result from the inspection unit 20 (S301). In the case where the inspection result is "non-defective" (YES in S302), the control unit 50 causes the laser cutter 33 to emit a laser beam using the cut path data (see FIG. 6) when the alignment mark sensor (not shown) of the cutting unit 32 detects the alignment mark in the image of the detection result. In this manner, the seal member 6 is cut in the area corresponding to the label image according to the cut path data (S303). To rephrase, the area of the base material 3 on which the label image is printed is separated from the remainder of the base material 3. This cut path corresponds to a "first cut line". Note that the cutting is not carried out in the case where a defective print has been determined in step S302 (NO in S302).

The control unit 50 determines whether or not the label is the final label after step S303 or when a determination of "NO" has been made in step S302 (S304). In the case where it has been determined that the label is not the final label (NO in S304), the process returns to step S301 and the cutting process is carried out again. When it is determined that the label is the final label (YES in S304), the cutting process ends.

The area of the roll paper S that has experienced the cutting process is then transported to the scrap removal unit 35. The control unit 50 causes the scrap removal unit 35 to carry out a scrap removal process (S106 in FIG. 5). In this scrap removal process, the scrap removal unit 35 peels away excess portions (unnecessary portions) of the seal member 6, aside from the labels, from the mount 5 by rotating the scrap take-up shaft 36 (that is, carries out scrap removal) (see FIG. 4). In this comparative example, label images whose inspection results indicate a defect are not cut, and thus are removed (as scrap) along with the excess portions. On the other hand, the non-defective label images remain on the mount 5 and are transported in the transport direction, and are taken up by the take-up drive shaft 42 in a roll.

Figure 10:
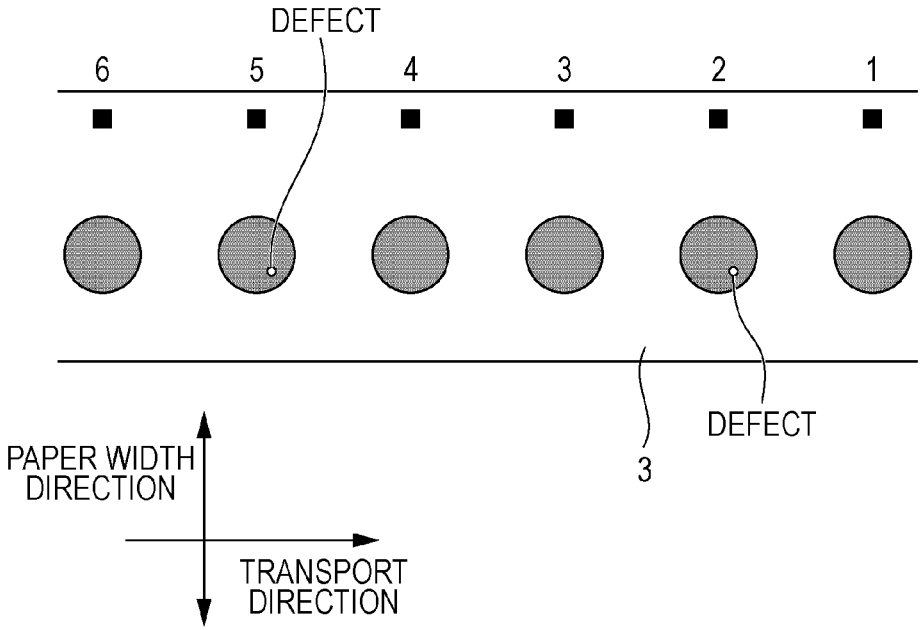
FIG. 10 is a diagram illustrating a printing result.
Figure 11:
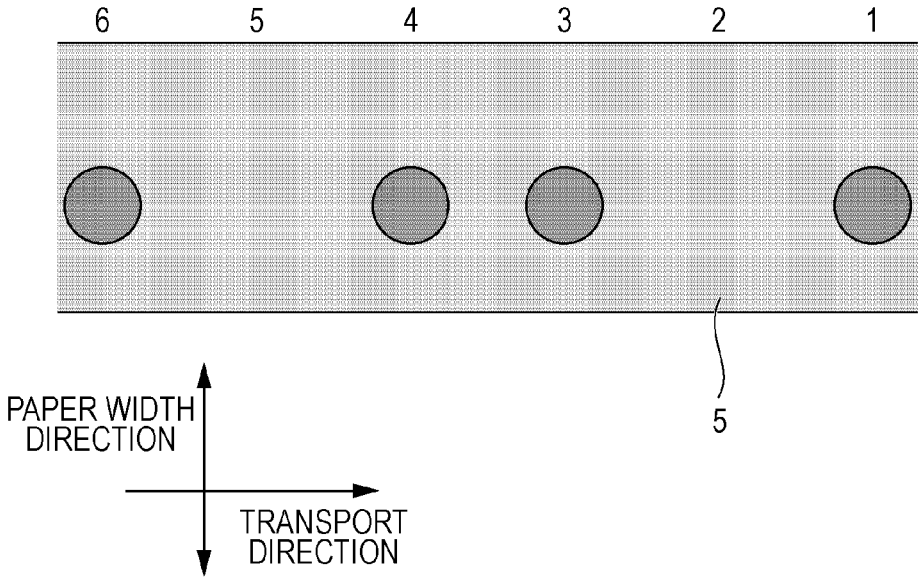
FIG. 11 is a diagram illustrating a state after cutting and scrap removal have been performed on the images shown in FIG. 10, according to the comparative example.

FIG. 10 is a diagram illustrating an example of a printing result. FIG. 11, meanwhile, is a diagram illustrating a state after cutting and scrap removal have been performed on the images shown in FIG. 10, according to the comparative example. Note that in these diagrams, a number is assigned for each printing operation performed based on the image data in FIG. 6 (that is, to each printed image), in order from the downstream side in the transport direction. For example, in FIG. 10, the second image and the fifth image are defective.

According to the comparative example, with the printing result shown in FIG. 10, the second and the fifth images are not cut. As a result, no images remain in the second and fifth positions following the scrap removal, as shown in FIG. 11. Note that the operator will apply non-defective label images to the areas of the images that have been peeled away.

According to the comparative example, the second and fifth images are peeled away without being cut, making it difficult to understand where to apply the label images; as a result, it is difficult for the operator to apply non-defective label images in precise positions.

Accordingly, an embodiment described hereinafter enables the positions where label images are to be applied to be understood in a precise manner.

2.6.2 Embodiment

Figure 12:
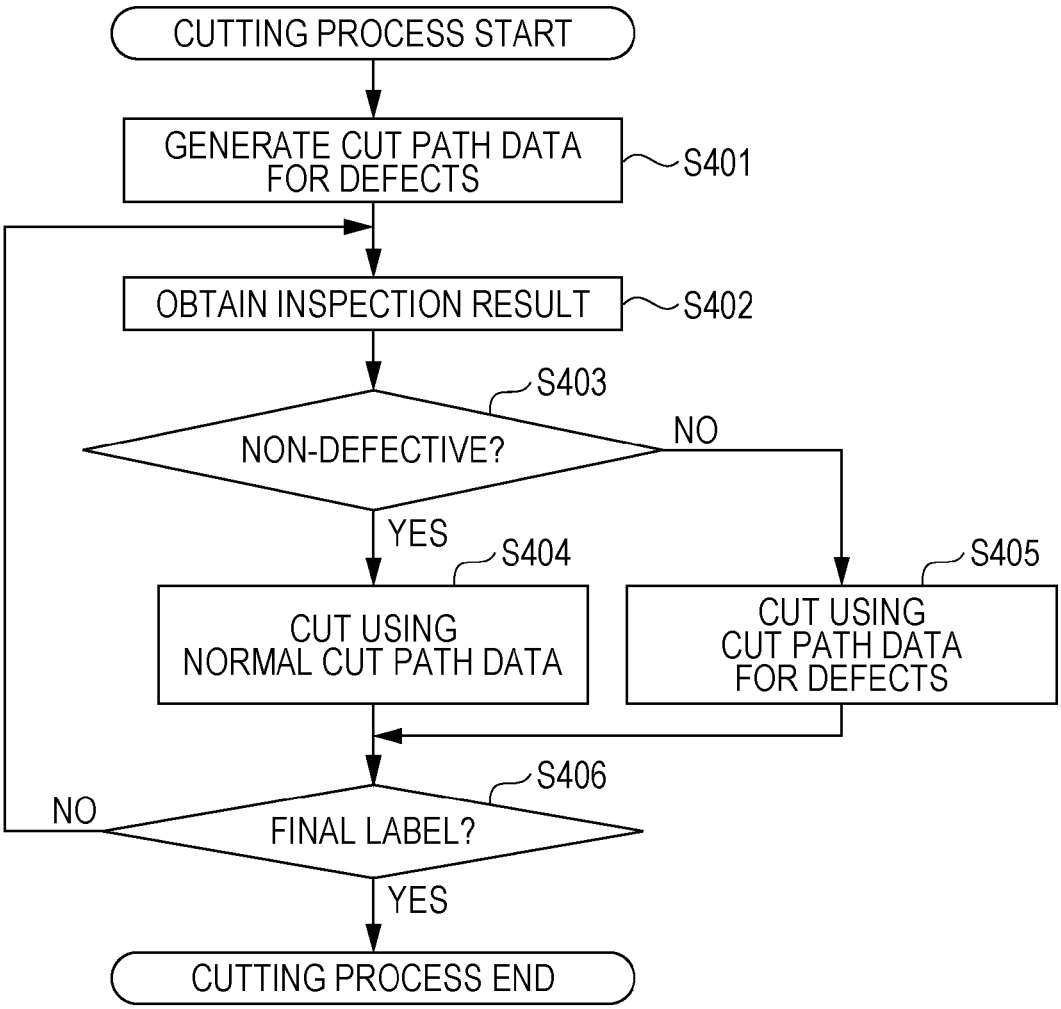
FIG. 12 is a flowchart illustrating operations performed in a cutting process according to a first embodiment.

FIG. 12 is a flowchart illustrating operations performed in a cutting process according to a first embodiment. Note that the configuration of the label production apparatus 1 and operations aside from the cutting process are the same as in the comparative example and thus descriptions thereof will be omitted.

First, the cut path generation unit 31 generates cut path data for a defective print based on the cut path data obtained from the print job (FIG. 6) (S401). Although the cut path for a defective print (corresponding to a "second cut line") is described here as being generated by the cut path generation unit 31, the invention is not limited thereto. For example, the cut path for a defective print may be obtained as part of the print job.

Figure 13:
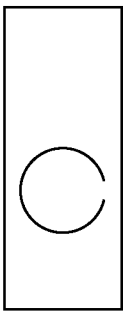
FIG. 13 is a diagram illustrating cut path data for a defective print according to the first embodiment.

FIG. 13 is a diagram illustrating cut path data for a defective print according to the first embodiment. As shown in FIG. 13, the cut path for a defective print is generated so that part of the cut path in FIG. 6 (a right-side end in the drawing) is not cut. In other words, a part of the print-defective image remains connected to the surrounding unnecessary portions even after the cutting.

Next, the control unit 50 obtains the inspection result from the inspection unit 20 (S402), and if the inspection result is "non-defective" (YES in S403), causes the cutting unit 32 to cut using the normal cut path (FIG. 6) (S404). On the other hand, in the case where the inspection result is "defective" (NO in S404), the cutting unit 32 is caused to cut using the cut path for a defective print (FIG. 13) (S405).

Thereafter, the control unit 50 determines whether the label is the final label (S406). If the label is not the final label (NO in S406), the process returns to step S402 and the cutting process is carried out again. If, however, the label is the final label (YES in S406), the cutting process ends.

Figure 14:
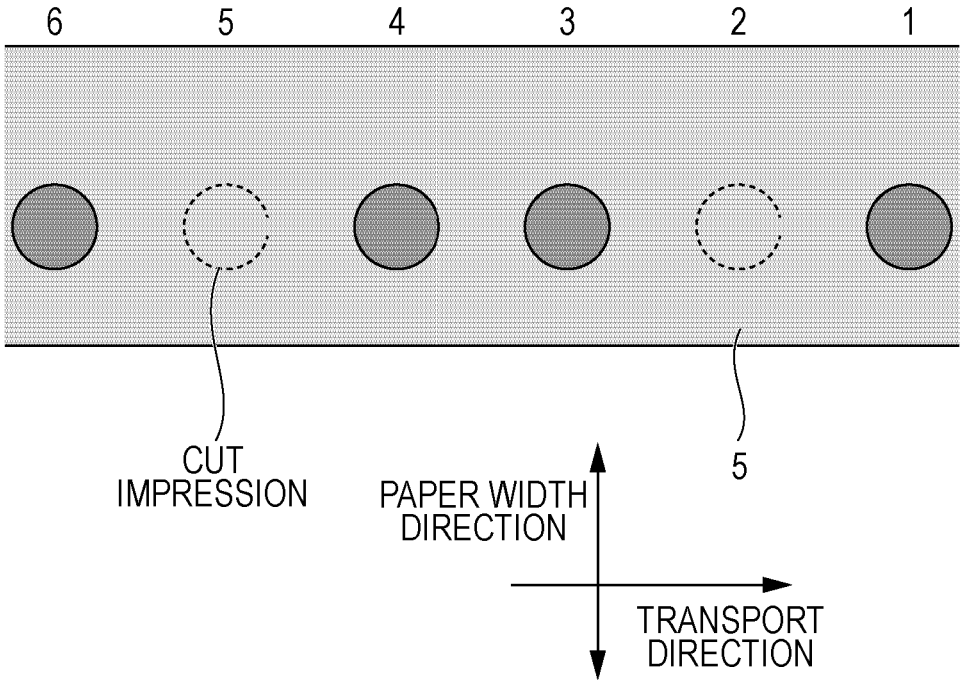
FIG. 14 is a diagram illustrating a state after cutting and scrap removal have been performed on the images shown in FIG. 10, according to the first embodiment.

FIG. 14 is a diagram illustrating a state after cutting and scrap removal have been performed on the images shown in FIG. 10, according to the first embodiment. In the first embodiment, defective prints are cut using the cut path shown in FIG. 13; accordingly, the seal member 6 at the area corresponding to the print-defective label image is not completely cut and partially remains (that is, remains connected to the unnecessary portion). Accordingly, the print-defective label image is also peeled away from the mount 5 during the scrap removal. However, in this embodiment, aside from the partially-remaining area, the print-defective label image is cut, resulting in a cut impression (an impression from cutting along the cut path in FIG. 13) remaining on the mount 5 along the outline of the label image, as shown in FIG. 14. Specifically, cut impressions remain in the locations where the second and fifth label images have been formed. Accordingly, compared to the comparative example (FIG. 11), it is easier for the operator to understand where to apply non-defective label images when applying such label images.

As described thus far, the label production apparatus 1 according to this embodiment includes the printing unit 13 that prints the label images onto the base material 3 of the roll paper S, the inspection unit 20 that inspects the label images printed onto the roll paper S, and the post-processing unit 30 that cuts the base material 3 (the seal member 6) in accordance with the inspection result from the inspection unit 20. The cutting unit 32 of the post-processing unit 30 cuts the base material 3 using the normal cut path, which causes the areas where the label image is formed to separate from the base material 3, in the case where the label image has been determined to be non-defective by the inspection unit 20, and cuts the base material 3 using the cut path for a defective print, in which part of the normal cut path is not cut, in the case where the label image has been determined to be defective.

Through this, print-defective label images are removed along with the unnecessary portions during scrap removal, and a cut impression remains on the mount 5 at the location of the print-defective label image. Accordingly, the positions where non-defective label images are to be applied can be made easy to understand.

Note that it is desirable for the portion left behind (the portion that is not cut) for a defective image to be located on the side from which the seal member 6 is peeled away from the mount 5 during scrap removal. For example, in this embodiment, as shown in FIG. 2, the seal member 6 is peeled away starting from the downstream side in the transport direction, and thus an area of the label image on the downstream side in the transport direction is not cut, as shown in FIGS. 13 and 14.

This is because if a part on the opposite side (that is, the upstream side in the transport direction) is left without being cut, it becomes difficult to completely peel away the label image (the print-defective label image) from the mount 5 during scrap removal, leading to a risk that the print-defective label image will remain on the mount 5.

3. Second Embodiment

In the first embodiment, there is one type of cut path for defects. In a second embodiment, a plurality of types of cut paths are generated for defects.

Figures 15A, 15B, 15C:
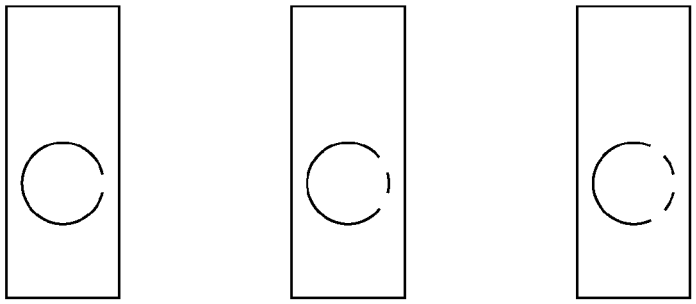
FIGS. 15A to 15C are diagrams illustrating cut path data for defects, generated according to a second embodiment.

FIGS. 15A to 15C are diagrams illustrating cut path data for defects, generated according to the second embodiment. The cut path generation unit 31 according to the second embodiment generates three types of cut paths as cut paths for defects.

As can be seen from FIGS. 15A to 15C, in FIG. 15A, one part of the label image is left (that is, is not cut). In FIG. 15B, two parts of the label image are left. Finally, in FIG. 15C, three parts of the label image are left.

Note that which of these three types is to be used may be specified by the operator, or may be set automatically in accordance with the material of the roll paper S. For example, when the type of the medium (the roll paper S) used in printing is specified, the cut path to be used may be selected automatically in accordance with the type of the medium. Specifically, a table that associates medium types (for example, the adhesive strength of the adhesive layer 4) with the three cut paths may be stored in the storage unit 52 in advance, and the cut path indicated in FIG. 15C may be selected in the case where a seal member 6 that strongly adheres to the mount 5 is used. In this case, there are many remaining (uncut) areas, and thus the print-defective label image can be peeled away from the mount 5 with certainty even when the adhesive force is strong. Conversely, the cut path indicated in FIG. 15A may be selected in the case where a seal member 6 that weakly adheres to the mount 5 is used. In this case, there are few remaining (uncut) areas, and thus more of a cut impression can be imparted, making it even easier to understand the locations where the label images are to be applied.

Although there are three types of cut paths in the second embodiment, the invention is not limited thereto, and there may be two types, or four or more types. However, it is desirable for at least the side from which the seal member 6 is peeled away from the mount 5 during the scrap removal to be left (to not be cut), in the same manner as in the first embodiment. Furthermore, rather than varying the number of areas that are not cut, the length of the area that is not cut may be varied, for example.

4. Third Embodiment

In the aforementioned embodiments, the number of label images formed in the paper width direction (that is, the number of images in the image data) is one. In a third embodiment, however, a plurality of (two) label images are formed in the paper width direction.

Figure 16:
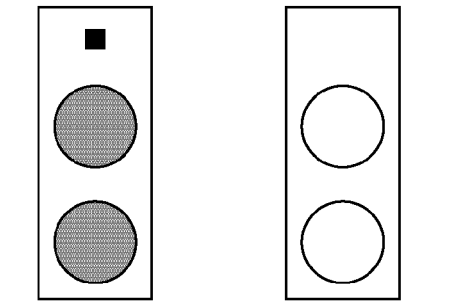
FIG. 16 is a diagram illustrating a print job obtained according to a third embodiment.

FIG. 16 is a diagram illustrating a print job obtained according to the third embodiment. As shown in FIG. 16, in the third embodiment, two images are present in a single piece of image data. Likewise, two pieces of cut path data are provided, corresponding to the label images.

In the following descriptions, the label image closer to the alignment mark (on top, in FIG. 16) will be referred to as an "upper section", whereas the label image further from the alignment mark (on the bottom, in FIG. 16) will be referred to as a "lower section".

In the third embodiment, printing using the image data shown in FIG. 16 results in the label images shown in FIG. 16 being printed onto the roll paper S.

Figures 17A, 17B, 17C:
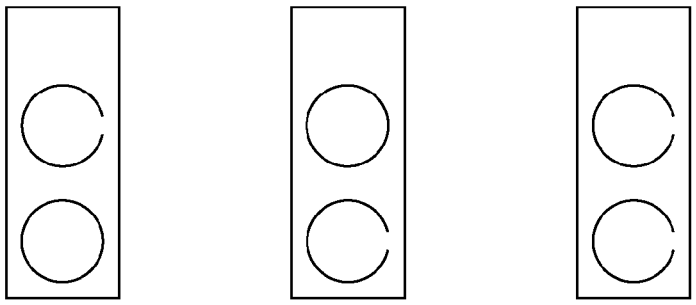
FIGS. 17A to 17C are diagrams illustrating cut path data for defects, generated according to the third embodiment.

FIGS. 17A to 17C are diagrams illustrating cut path data for defects, generated according to the third embodiment. In the third embodiment, when a defective print occurs, three types of cut paths (cut paths for defects) are generated as indicated in FIGS. 17A to 17C, in accordance with the location of the defect. FIG. 17A indicates a cut path for the case where the image in the upper section is defective. FIG. 17B indicates a cut path for the case where the image in the lower section is defective. FIG. 17C indicates a cut path for the case where both the upper and lower sections are defective.

For example, when the inspection unit 20 detects a defective print in the upper-section image after printing using the image data in FIG. 16, the cut path indicated in FIG. 17A is used when cutting using the cutting unit 32. As a result, the upper-section image is not completely separated, and is therefore peeled away from the mount 5 during scrap removal. Even in this case, a cut impression remains on the mount 5 in the area where the defective label image has been printed, and thus it is easy for the operator to understand the position where a non-defective label image is to be applied when applying such a label image.

Likewise, when the inspection unit 20 has detected a defective print in a lower-section image, the cut path indicated in FIG. 17B is used when cutting with the cutting unit 32. The cut path indicated in FIG. 17C is used when a defective print has been detected in both the upper-section and the lower-section images. Even in these cases, cut impressions remain on the mount 5 in the areas where the print-defective label images have been formed. Accordingly, the positions where non-defective label images are to be applied can be made easy to understand when applying such label images.

Although the third embodiment describes printing two label images in a row in the paper width direction, the invention is not limited thereto, and three or more label images may be printed in a row. In this case, a corresponding number of cut paths such as those shown in FIGS. 17A to 17C may be generated in accordance with the number of label images formed in the paper width direction.

5. Fourth Embodiment

A fourth embodiment differs from the aforementioned embodiments in terms of the method for generating the cut path for a defect. Aside from the method for generating the cut path for a defect, the fourth embodiment is the same as the first embodiment, and thus redundant descriptions will be omitted.

Figure 18:
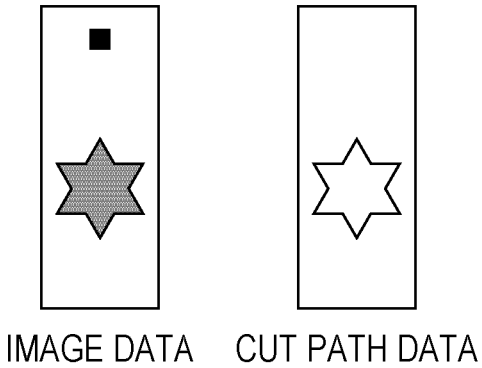
FIG. 18 is a diagram illustrating data obtained from a print job according to a fourth embodiment.
Figure 19:
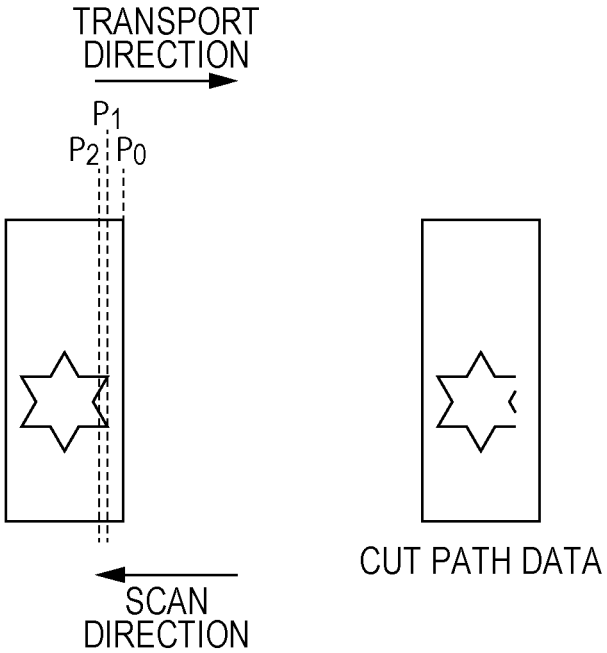
FIG. 19 is a schematic diagram illustrating the generation of a cut path for a defective print, according to the fourth embodiment.

FIG. 18 is a diagram illustrating data obtained from a print job according to the fourth embodiment. FIG. 19, meanwhile, is a schematic diagram illustrating the generation of a cut path for a defective print, according to the fourth embodiment. Note that in the fourth embodiment, an image of a six-pointed star (that is, a label image) is printed, as shown in FIG. 18. Cut path data corresponding to this image data (a cut path for a non-defective image) is also obtained. The cut path generation unit 31 according to the fourth embodiment scans the cut path data shown in FIG. 18 from the right side thereof (the end thereof on the side corresponding to the downstream side in the transport direction) and generates a cut path for a defective image.

Specifically, first, the scan starts from a position P0 on the right side of the cut path data and progresses to the left (that is, in the opposite direction to the transport direction). The right end of the image is detected at a position P1. After this position has been marked, a predetermined amount (5 mm, for example) is further scanned in accordance with settings. A position P2 is a position reached by moving the predetermined amount. The data between the position detected initially (the position P1) and the position reached by moving the predetermined amount from the position P1 (the position P2) is deleted from the cut path data shown in FIG. 18. As a result, cut path data such as that shown in the right side of FIG. 19 is generated.

Figure 20:
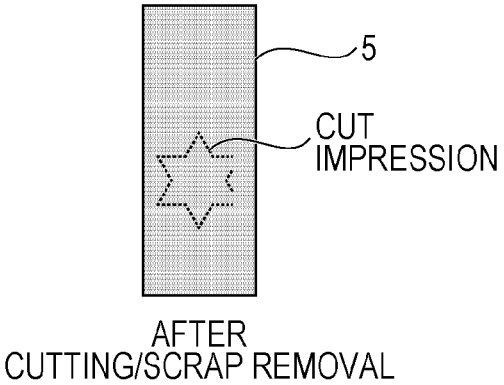
FIG. 20 is a diagram illustrating a state after cutting and scrap removal have been performed using the cut path shown in FIG. 19.

FIG. 20 is a diagram illustrating a state after cutting and scrap removal have been performed using the cut path shown in FIG. 19. Note that FIG. 20 shows only a print-defective portion. As indicated in FIG. 20, the image has been removed, and a cut impression having the shape of the image data (a six-pointed star) remains upon the mount 5. The cut impression remains in this manner, and thus it is easy for the operator to understand the position where the non-defective label image is to be applied when applying such a label image. Note that non-defective images are cut into the six-pointed star shaped as per the image data. Through this, six-pointed star shaped label images remain on the mount 5 after the scrap removal.

6. Fifth Embodiment

A fifth embodiment differs from the fourth embodiment in terms of the method for generating the cut path for a defect.

Aside from the method for generating the cut path for a defect, the fifth embodiment is the same as the first embodiment, and thus redundant descriptions will be omitted. In addition, the print job obtained in the fifth embodiment is the same as that obtained in the fourth embodiment (FIG. 18).

The cut path generation unit 31 according to the fifth embodiment generates cut paths for defects as described hereinafter, based on the cut path data (FIG. 18) in the print job.

Figures 21A, 21B, 21C:
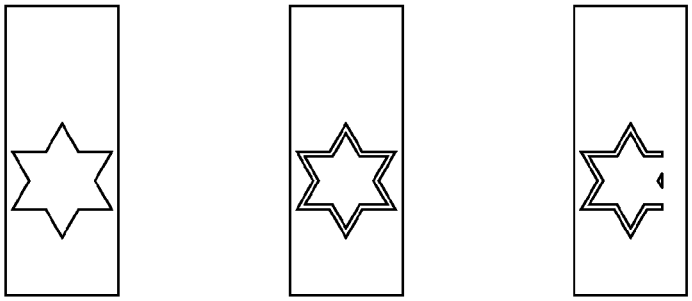
FIGS. 21A to 21C are diagrams illustrating a method for generating a cut path for a defect, according to a fifth embodiment.

FIGS. 21A to 21C are diagrams illustrating a method for generating a cut path for a defect, according to the fifth embodiment.

First, the cut path generation unit 31 generates data in which the cut path data shown in FIG. 18 has been enlarged by a predetermined rate, as shown in FIG. 21A. In this embodiment, the cut path is enlarged 1.2 times without moving the center of the cut path.

Next, the cut path generation unit 31 combines the cut path data shown in FIG. 18 with the cut path data shown in FIG. 21A. Cut path data such as that shown in FIG. 21B is obtained as a result.

Then, the cut path generation unit 31 deletes the right side (the downstream side, in the transport direction) of the cut path data shown in FIG. 21B using the same method as in the fourth embodiment. Cut path data such as that shown in FIG. 21C is obtained as a result.

Figure 22:
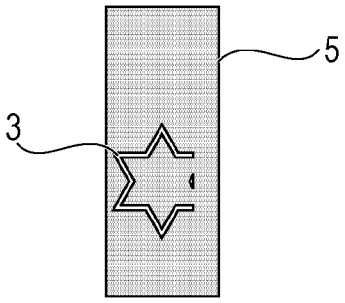
FIG. 22 is a diagram illustrating a state after cutting and scrap removal have been performed using the cut path data shown in FIG. 21.

FIG. 22 is a diagram illustrating a state after cutting and scrap removal have been performed using the cut path data shown in FIG. 21. As shown in FIG. 22, the label image (the print-defective label image) has been removed as scrap along with the unnecessary portions. However, in the fifth embodiment, the base material 3 remains in the periphery of the label image. Accordingly, the position where the non-defective label image is to be applied can be made easy to understand when applying that label image even after the print-defective label image has been peeled away.

Note that the base material 3 that remains in the periphery of the label image in FIG. 22 is removed after the non-defective label image has been applied.

A cut path for a defective print can be generated in this manner.

In this embodiment, the cut path is enlarged and the enlarged cut path is combined with the original cut path, and thus the shapes of the inner line and the outer line are analogous; however, the invention is not limited thereto. For example, a circle that surrounds the label image may be combined with the original cut path. In this case, the outer line is circular, whereas the inner line has the six-pointed star shape. Any shape is acceptable as long as the base material 3 remains in the periphery of the label image after the scrap removal (that is, as long as an inner edge is present).

7. Other Embodiments

The aforementioned embodiments have been provided to facilitate understanding of the invention and are not to be interpreted as limiting the invention in any way. It goes without saying that many variations and modifications can be made without departing from the essential spirit of the invention, and thus all the equivalent entities including such variations and modifications also fall within the scope of the invention. In particular, the embodiments described hereinafter also fall within the scope of the invention.

Printing Unit 13

Although the aforementioned embodiments described the printing unit 13 as a line printer, the invention is not limited thereto. For example, the printing unit 13 may have a plurality of heads disposed opposing the circumferential surface of a cylindrical transport drum, and images may be formed on a medium while that medium is being transported along the circumferential surface of the transport drum by ejecting ink from the respective heads onto the medium. Furthermore, the printing unit 13 may, for example, be a printer that forms images in a printing region by repeatedly alternating operations for ejecting ink onto a medium that has been transported to the printing region while moving a head in the transport direction of the medium and operations for moving the head in the width direction of the medium, and then transporting an area of the medium that has not yet been printed onto to the printing region (that is, the printing unit 13 may be a lateral printer).

Ejection System

The system for ejecting ink from the heads may be a system that ejects the ink using piezoelectric elements, or may be a system that ejects ink by using bubbles produced by heat within the nozzles. Other systems may be used as well.

Medium

The aforementioned embodiments give the roll paper S as an example of the medium, but the invention is not limited thereto, and any medium may be used as long as it is formed having three layers, namely the base material 3, the adhesive layer 4, and the mount 5. For example, the medium may be pre-cut paper. Furthermore, the materials of the three layers are not limited. For example, the base material 3 may be a film.

Ink

Although the aforementioned embodiments use four colors of ink, namely cyan, magenta, yellow, and black, as ink for forming color images, other colors of ink (for example, light cyan, light magenta, and so on) may be used as well.

In addition, UV curing ink cured by being irradiated with ultraviolet light (UV) may be used. In this case, the dots can be fixed on the medium by providing light sources that emit UV downstream from the respective heads in the transport direction and irradiating the medium with the UV after dot formation. This makes it possible to obtain favorable printing even on a medium that does not easily absorb ink.

Label Images

Although the aforementioned embodiments describe shapes such as a circle, a six-pointed star, and the like as being printed as the label images, the invention is not limited thereto, and the label images may be other shapes, graphics, symbols (text), or the like. Furthermore, although the aforementioned embodiments describe one or two label images being disposed in the paper width direction, the invention is not limited thereto, and three or more label images may be disposed in the paper width direction, for example.

Inspection Unit 20

Although the aforementioned embodiments use the scanner 21 to inspect whether or not the label images are non-defective, the invention is not limited thereto. For example, a system in which defective areas (areas where ink has not been ejected) are detected in real time based on electrical signals indicating residual vibrations when ink is ejected from the heads may be used instead.

Post-Processing Unit 30

Although the aforementioned embodiments describe the post-processing unit 30 as including the cutting unit 32 and the scrap removal unit 35, the invention is not limited thereto. For example, the scrap removal unit may be provided as a separate unit (a separate entity), and that unit may only remove scrap from the roll paper S after the cutting.

The entire disclosure of Japanese Patent Application No. 2013-068290, filed Mar. 28, 2013 is expressly incorporated by reference herein.

What is claimed is:

1. A label production apparatus comprising:

a printing unit that prints a label image onto a first base material of a printing medium that includes the first base material, a second base material, and an adhesive layer between the first base material and the second base material;

an inspection unit that inspects the label image printed onto the printing medium;

a post-processing unit that cuts the first base material based on an inspection result from the inspection unit, the post-processing unit cutting the first base material using a first cut line that separates an area where the label image is formed from the first base material in the case where a print defect has not been detected in the label image by the inspection unit, and cutting the first base material using a second cut line in which part of the first cut line is not cut in the case where a print defect has been detected in the label image by the inspection unit; and a storage unit that stores a table associating a type of the printing medium with a range in which the first base material is not cut, wherein the second cut line is generated by the label production apparatus based on the printing medium being used by referring to the table.

2. The label production apparatus according to claim 1, further comprising:

a peeling unit that, after the first base material has been cut by the post-processing unit, peels an area of the first base material, aside from the label image, that has been cut along the first cut line away from the second base material starting from a predetermined side, wherein the second cut line does not cut an area on the predetermined side of the first cut line.

3. The label production apparatus according to claim 2, wherein in the peeling unit, the printing medium is transported in a transport direction; and the predetermined side is a downstream side in the transport direction.

4. The label production apparatus according to claim 2, wherein the second cut line is generated so that an area of the first base material surrounding the label image remains on the second base material after the peeling performed by the peeling unit.

5. A label production method comprising:

printing a label image onto a first base material of a printing medium that includes the first base material, a second base material, and an adhesive layer between the first base material and the second base material;

inspecting the label image printed onto the printing medium;

post-processing to cut the first base material based on an inspection result from the inspecting, in which the first base material is cut using a first cut line that separates an area where the label image is formed from the first base material in the case where a print defect has not been detected in the label image in the inspecting, and the first base material is also cut using a second cut line in which part of the first cut line is not cut in the case where a print defect has been detected in the label image in the inspecting;

storing a table associating a type of the printing medium with a range in which the first base material is not cut, wherein the second cut line is generated based on the printing medium being used by referring to the table.

* * * * *